US008632427B2

(12) United States Patent
Dastrup

(10) Patent No.: US 8,632,427 B2
(45) Date of Patent: Jan. 21, 2014

(54) GOLF GREEN SLOPE READING AID

(76) Inventor: David Dastrup, Escondido, CA (US)

( * ) Notice: Subject to any disclaimer, the term of this patent is extended or adjusted under 35 U.S.C. 154(b) by 111 days.

(21) Appl. No.: 13/232,960

(22) Filed: Sep. 14, 2011

(65) Prior Publication Data

US 2012/0065001 A1 Mar. 15, 2012

Related U.S. Application Data

(60) Provisional application No. 61/382,831, filed on Sep. 14, 2010.

(51) Int. Cl.
*A63B 69/36* (2006.01)

(52) U.S. Cl.
USPC ..... 473/404; 473/219

(58) Field of Classification Search
USPC ..... 473/219, 220, 404
See application file for complete search history.

(56) References Cited

U.S. PATENT DOCUMENTS

| | | | | | |
|---|---|---|---|---|---|
| 4,239,216 | A | * | 12/1980 | Bauer | 473/285 |
| 5,174,572 | A | * | 12/1992 | Ho | 473/241 |
| 5,356,133 | A | * | 10/1994 | Bellagamba | 473/406 |
| 5,582,554 | A | * | 12/1996 | Stryczek | 473/407 |
| 5,632,484 | A | * | 5/1997 | Lambert | 473/241 |

* cited by examiner

*Primary Examiner* — Vishu K. Mendiratta
(74) *Attorney, Agent, or Firm* — The Law Office of Jane K. Babin, Professional Corporation; Jane K. Babin

(57) ABSTRACT

The present invention provides a golf aid for determining the slope of putting green or other area of a golf course. More specifically, the invention provides a device for calibrating suspending Optionally, the device includes a ball marker and can include tools for assembling the device in a golf club.

2 Claims, 6 Drawing Sheets

GOLF GREEN SLOPE READING AID

RELATED APPLICATIONS

This application claims the benefit of priority under 35 USC §119 of U.S. Provisional Application Ser. No. 61/382,831 filed Sep. 14, 2010, the entire disclosure of which is incorporated herein by reference.

FIELD OF THE INVENTION

The present invention relates generally to the field of golf aids. More specifically, the invention relates to a device for determining the slope of putting green or other area of a golf course. Optionally, the device includes a ball marker and can include tools for assembling the device in a golf club.

BACKGROUND OF THE INVENTION

Golf is a widely popular sport that more than 60 million people in the world play on a regular or casual basis. There are more than 30,000 golf courses worldwide, each with its own unique geography. The variability of courses is at once a challenge that keeps the game of golf interesting and an obstacle for the competitive golfer to overcome.

Scores of golfing aids have been developed to assist golfers in improving their game, both at the learning or practice stage, and in more competitive situations of tournament play. Among these are devices useful for determining range and course characteristics, which in turn enable a golfer to estimate the club, stroke, force and trajectory that must be used to deliver a golf ball to a hole (cup) in the minimum number of strokes, which is the essence of the game of golf. Basic information about the various holes of a particular golf course, such as distance from the tee to the green, positions of hazards and other physical characteristics, may be available from the course management, from third parties (often for a fee), or may be complied by the individual golfer who records measurements and keeps notes about a particular course. Such maps and "yardage books" are only the beginning in assessing and mastering a course. More sophisticated technology is also available in the form of GPS systems, laser guides and rangefinders, computerized terrain and topography analysis devices, and even systems designed to predict the trajectory that a golf ball must take to fall into a golf cup.

However, such equipment can be expensive and cumbersome, often requiring mounting to a golf cart and protection from the elements of nature. More importantly, the rules and governing bodies of golf (e.g., The Royal and Ancient Golf Club of St Andrews (R&A) and The United States Golf Association (USGA)) disfavor the use of advanced technology and prohibit such devices during tournament play. Thus, golfers may use technologically advanced tools to learn and practice playing golf, but must wean themselves from the tool if they wish to participate in competitive play according to standardized rules.

There is thus a need for an uncomplicated, agile device to aid golfers in assessing the terrain of a golf course, which can be used in any situation, including competition, and is at once affordable, accessible and useful to a wide range of golfers—from the novice to the professional.

SUMMARY OF THE INVENTION

The present invention provides a device for reading the slope of a golf green that includes: a generally conical body having a top, a bottom that is narrower than the top and at least one side, wherein the bottom has an outer diameter that is smaller than the inner diameter of the grip end of a generally hollow golf club shaft (typically between about 0.485" to about 0.68"), and the top has an outer diameter that is larger than the inner diameter of the golf club shaft, such that at least the top of the device is retained outside the golf club shaft when the bottom is rotatably inserted therein; a pair of positional balance markers disposed on opposite sides of a top portion of the body; and a means for securing the device in a fixed position in the generally hollow golf club shaft. In certain aspects, the at least one side is stepped to form an upper step portion adjacent to the top and a lower step adjacent to the bottom, wherein the lower step fits rotatably within generally hollow golf club shaft. In certain embodiments, the at least one side is tapered, such as continuously tapered from top to bottom.

The positional balance markers can include raised protrusions, such as facets, disposed on opposite sides of the device that can be felt by the operator. The positional balance markers in certain aspects can include indentations that can be felt by the operator and/or markings or engraving.

In embodiments of the invention, the means for securing the device in a fixed position includes at least one screw and/or at least one spike. In yet further embodiments, the means for securing the device in a fixed position includes an expansion tube, a wedge, a bolt and nut, wherein the expansion tube is a generally cylindrical member adapted at one end for accepting the bottom of the device, and at the other end for accepting the top of the wedge; wherein he the expansion tube, wedge and device are assembled together with the bolt and nut. For example, the top of the wedge and the bottom of the device can include male type fittings and that are mated to female fittings on the expansion tube.

Optionally, the device can include a ball marker and the device can be adapted to accept the ball marker. In other aspects, the device optionally includes at least one tool for installing or securing the device in a hollow golf club shaft, such as a knife blade and screwdriver.

The invention also provides methods for assessing the slope of a golf green including the steps of inserting a device described herein into the hollow shaft of a golf club, thus forming a device-golf club assembly; calibrating the device-golf club assembly such that at least one viewing edge of the golf club shaft is parallel to a reference plumb line when the assembly is suspended by an operator above ground directly in front of the operator from the positional balance markers; securing the device in the calibrated position; suspending the device-golf club assembly from the positional balance markers above ground directly in front of the operator such that the at least one viewing is plumb; and comparing the slope of the golf green to the edge of the golf club

BRIEF DESCRIPTION OF THE DRAWINGS

FIG. 6 illustrates the effect of calibration of the device inserted into a golf club shaft.

DETAILED DESCRIPTION

Figure 3:
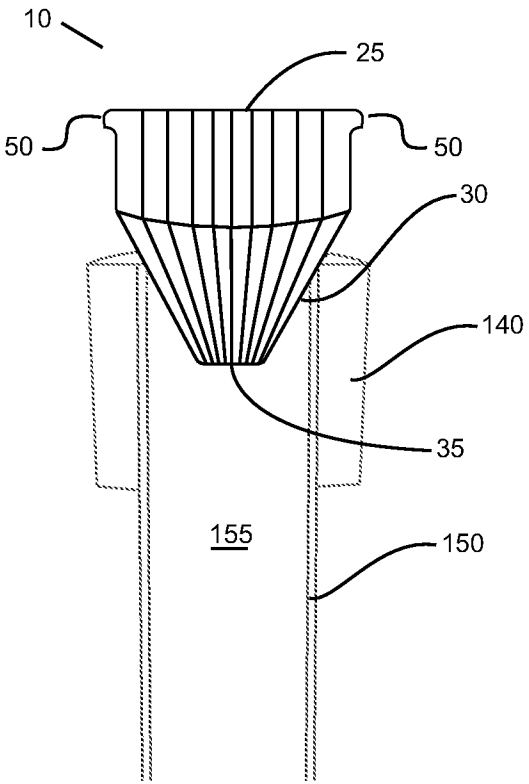
FIG. 3 shows an exemplary device according to an embodiment of the invention having ridges

It is to be understood that both the foregoing general description and the following detailed description are exemplary and explanatory only and are not restrictive of the invention claimed. As used herein, the use of the singular includes the plural unless specifically stated otherwise. As used herein, "or" means "and/or" unless stated otherwise. Furthermore, use of the term "including" as well as other forms, such as "includes," and "included," is not limiting. The section headings used herein are for organizational purposes only and are not to be construed as limiting the subject matter described.

Unless specific definitions are provided, the nomenclatures utilized in connection with, and the procedures, techniques, and equipment of sports, sporting goods and the golf industry described herein are those known in the art, such as those set forth in "Golf Rules Illustrated Effective Through 2011" U.S.G.A. (Hamlyn, London; Mar. 4, 2008).

"About" as used herein means that a number referred to as "about" comprises the recited number plus or minus 1-10% of that recited number. For example, "about" 100 inches can mean 95-105 inches or as few as 99-101 inches depending on the situation. Whenever it appears herein, a numerical range such as "1 to 20" refers to each integer or fractional unit thereof in the given range; for example and without limitation to a specific range content, "1 to 20 inches" means that a specified measurement can be 1 inch, 2 inches, 3 inches, etc., up to and including 20 inches, while 1.1 to 20.0 inches means that a specified measurement can be 1.1 inch, 1.2 inches, 1.3 inches, etc., up to and including 20.0 inches, The present invention provides a simple, yet elegant solution to many of the problems described above. In one embodiment, the present invention provides a device that allows the user to assess the vertical and horizontal orientation of a region of a golf course, and in particular, of a putting green. Given the assessment facilitated by the invention device, the golfer can determine the appropriate direction to stroke a golf ball on the green or other location on the course, such that ball is directed to the desired location. To maximize efficiency, the invention device utilizes the golf club itself in providing positional information to the golfer, and is adapted to fit within the grip end of the club.

In a basic embodiment, the invention provides a means for suspending a golf club in a plumb-orientation position. According to this embodiment, the invention device is inserted into the grip end of a golf club, calibrated to an external plumb line and secured in position within the shaft of the club. The device includes fixed balance position markers that, in certain aspects, can be grasped lightly between two fingers, thereby suspending the club. The weight of the golf club head acts as a plumb bob (plummet) and allows the shaft of the club to hang under the force of gravity at a perfectly vertical (i.e. plumb) orientation. When suspended in advance of the golfer's line of sight, the plumb line visible as a calibrated edge of the shaft of the club provides a simple, yet invaluable guide to assessing the slope of the terrain.

Figure 1:
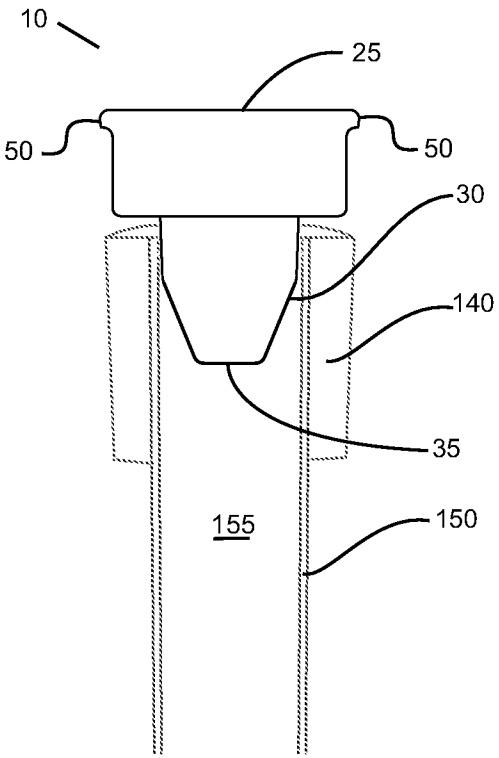
FIG. 1 shows an exemplary device according to an embodiment of the invention.

Referring to FIG. 1, in one embodiment, the invention device is a generally conical body, which may be hollow and having a top 25, a bottom 35 that is narrower than the top, and at least one side 30. More particularly, the bottom 35 has an outer diameter that is smaller than the inner diameter of a generally hollow golf club shaft, while the top 25 has an outer diameter that is larger than the inner diameter of the golf club shaft and is thereby retained outside the golf club shaft 155 when inserted therein.

Figure 2:
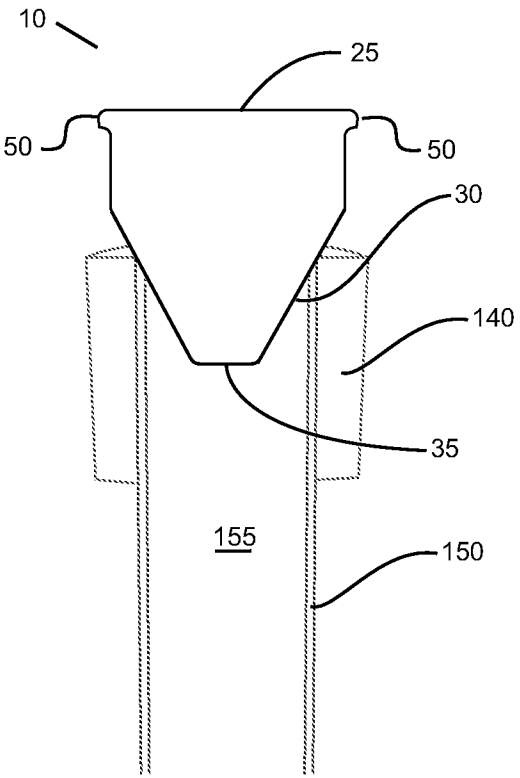
FIG. 2 shows an exemplary device according to an embodiment of the invention.

The at least one side 30 of the invention device can have a stepped configuration as shown in FIG. 1, such that a larger step is formed adjacent to the top end of the device and such larger step portion of the device is retained outside the grip 140 end of a golf club shaft when the device is inserting into the golf club shaft. In other embodiments, the at least one side 30 is tapered from top to bottom as illustrated in FIG. 2, or partially tapered. The skilled artisan will appreciate that the generally continuous side 30 can be replaced by a plurality of sides, such as 3 sides, 4 sides, 5 sides, 6 sides, etc. up to and including more than 100 sides (see FIG. 3). In certain aspects, the at least one side include grooves, ridges, baffles and/or other features that will be known to those skilled in the art to assist in tightly fitting one object into another.

Disposed on opposite sides of a top portion of the device are two positional reference balance markers 50. In certain embodiments, the balance markers have a three-dimensional shape that can be felt by the operator, such as a protrusion, which may be a smooth or faceted raised bump or ridge, or indentation, groove or the like. In other embodiments, the balance markers are printed or etched on a surface of the device, such as with paint or engraving. The top portion on which the balance markers are disposed is typically the top side as shown in FIG. 1-3, but can also be the top of the invention device. Advantageously, three dimensional balance markers disposed on opposite upper sides of the device can conveniently be felt by the operator and the operator can grasp the device at these points using only tactile feedback, which confirms proper grasp of the device. When the balance markers are located on the top of the invention device, or when the balance markers do not provide tactile input, the operator must visually locate the balance markers and grasp the device accordingly.

Figures 4A, 4B, 4C, 4D:
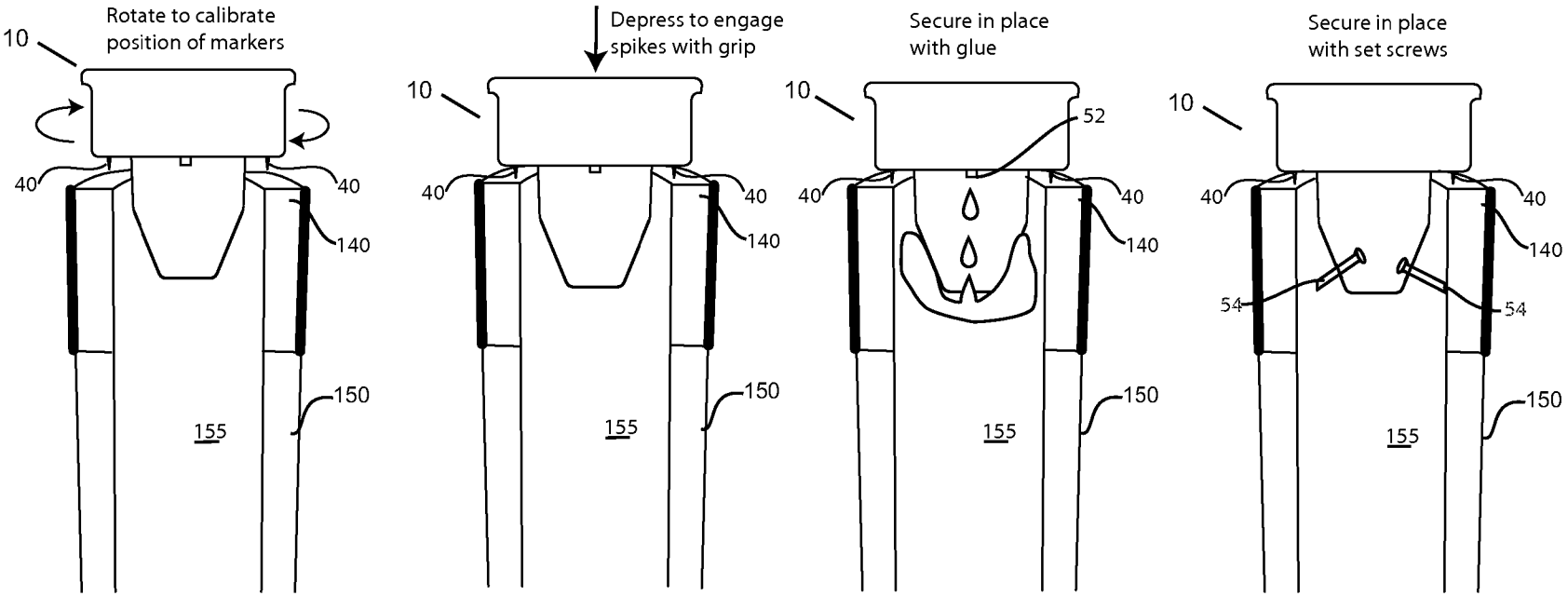
FIG. 4A illustrates an embodiment of inserting and calibrating a device according to the invention into the shaft of a golf club.
FIG. 4B illustrates engaging the spikes of the device shown in 4A in the grip end of the golf club.
FIG. 4C illustrates securing the device of FIGS. 4A and 4B in the golf club shaft using glue.
FIG. 4D illustrates securing the device of FIGS. 4A and 4B in the golf club shaft using set screws.

Disposed on the device according to embodiments of the invention is a means for securing the device in a desired position in the shaft of the club. In one embodiment of the invention, the means for securing the device includes at least one protruding element 40, such as a spike, that can be engaged with the grip end of a golf club shaft, thereby preventing the device from rotating within the golf club shaft as illustrated in FIGS. 4A and 4B. When present, spikes will generally be 0.01 to about 0.1" long; frequently about 0.04 to 0.08" long and most often, about 0.06" long. In certain aspects, the device includes 2, 3, 4 or more protruding elements 40. FIG. 4A shows the device partially inserted in the grip end of a golf club shaft such that the top is freely rotatable within the shaft. In FIG. 4B, the device has been inserted farther into the shaft, thereby engaging the protruding elements 40 with the grip end of the golf club to prevent the device from rotating. In other embodiments, rotation can be prevented with other means known in the art. For example, the spikes illustrated in FIG. 4A can be replaced with an adhesive, such as glue or double-sided tape. In yet further embodiments, at least one screw and mated screw hole or other fastening device can be provided be driven through a top portion of the device into the grip of the golf club.

The means for securing the device in a desired position in the shaft of the club can also include means that secures a bottom portion of the device to an inner surface of the golf club shaft. As illustrated in FIG. 4C, such means can include an adhesive, such as glue, paste, cement, tape or film that is applied to the bottom of the device. Such adhesive can be applied to the device prior to insertion in to the golf club shaft and calibration of plumb, or can be applied after insertion and calibration through at least one access hole or port in a bottom portion of the device.

In other embodiments, the means for securing the device in a desired position in the shaft of the club can include screws, wings or other fasteners disposed on a bottom portion of the device that can be expanded, screwed, driven or the like to contact an inner surface of the golf club shaft. For example, one or more set screws 54 can be disposed on an inner surface of the device and screwed into the golf club shaft inner surface to secure an invention device in the shaft of a golf club as shown in FIG. 4D.

Figure 5A:
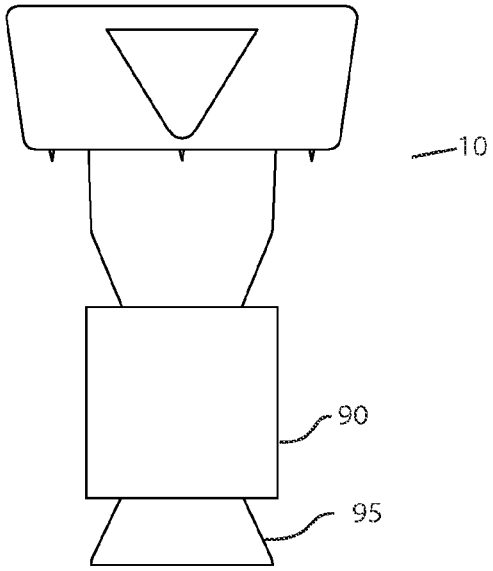
FIG. 5A shows an exemplary device according to an embodiment of the invention that includes an expansion tube and wedge for securing the device in the golf club shaft.
Figure 5B:
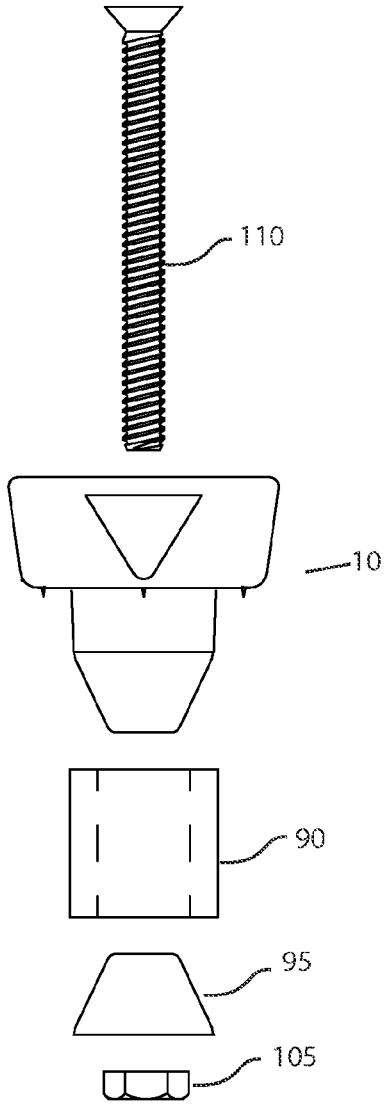
FIG. 5B is an expanded view of the device shown in FIG. 5A.

In yet a further embodiment of the invention, the means the means for securing the device in a desired position in the shaft of the club includes an expansion tube 90 disposed at the bottom end of the device and wedge 95 disposed at the distal end of the expansion tube, as illustrated in FIGS. 5A and 5B. Expansion tube 90 is a cylindrical, generally hollow tube that fits within hollow golf club shaft. Wedge 95 is a generally conical body that is sufficiently rigid to expand the golf club shaft when inserted therein under the application of moderate manual force. In certain aspects, the bottom of the device and the top of the wedge are fitted with "male" type ends that are mated with receptive (i.e. "female") ends of the expansion tube, or are otherwise adapted for connection to the expansion tube. The expansion tube and the wedge are connected to the device, for example, through a bolt 110 inserted from top to bottom of the device (i.e., through a screw hole through the center of expansion tube 90 and through the center and out the bottom of wedge 95) and secured with nut 105 to form a device/wedge assembly. The skilled artisan will appreciate that nut 105 can be, for example, a specially adapted lock nut, or it can be affixed (e.g., welded or soldered) to the distal end of the wedge, in various embodiments. The wedge end of the device/wedge assembly is inserted into the hollow grip end of the golf club and moderate manual force is applied, thereby expanding the golf club shaft, such that the top of the device remains rotatable within the golf club shaft. Once the desired position of the device is achieved, bolt 110 is tightened; thereby engaging e.g. spikes 40 with the grip end of the club, and securing the device/wedge assembly in the desired position in the shaft of the club. Advantageously, devices of this configuration can be quickly assembled in the shaft of a golf club with simple tools and manual force. In addition, such devices can be removed for cleaning, replacement or installation in a different golf club. Nevertheless, the embodiments illustrated are not intended to limit the means for securing the device within the golf club shaft and the skilled artisan will be aware of a variety of alternative means that may be used, such as crimps, ridges, wings, adhesives and the like.

Figure 6A:
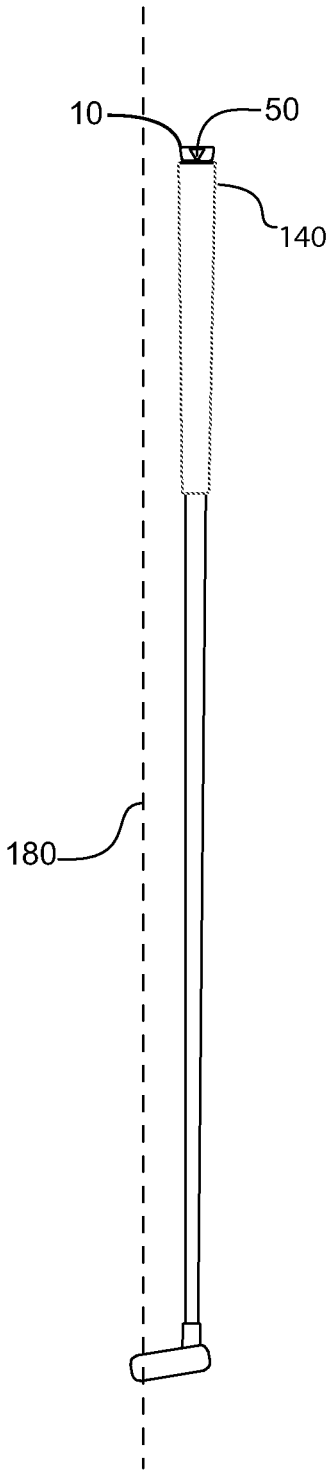
FIG. 6A shows the selected viewing edge of, which is parallel to plumb.
Figure 6B:
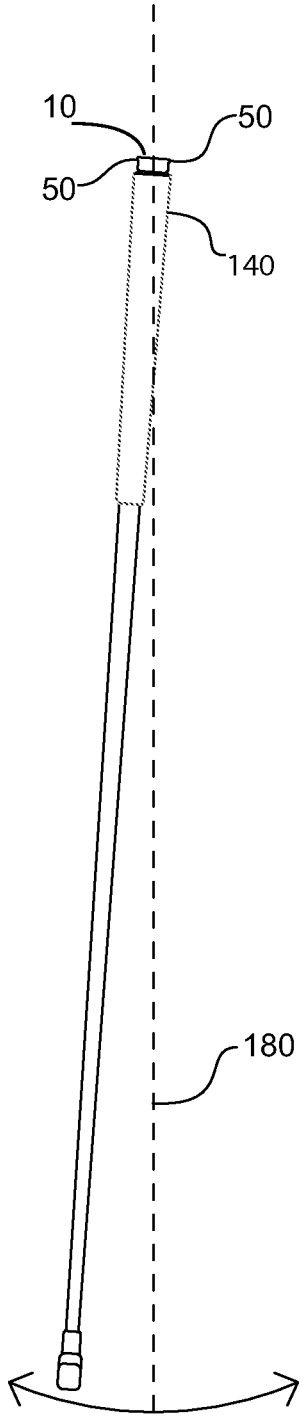
FIG. 6B shows the same calibrated golf club/device assembly when rotated 90 degrees. In this orientation, the selected viewing edge is not visible, and the club may hang with a forward or backward lean (arrows).

In use, the device is inserted into the shaft of a golf club and suspended between two fingers placed on or near the positional balance markers. The club is elevated in this position at or about arm's length from the operator, and allowed to hang freely while being held at the balance markers with the golf club head pointing toward, but not touching the ground. The operator selects either the left or right side of the suspended golf club shaft for viewing, and by looking past the selected viewing edge toward a vertical plumb line 180 (e.g. door jamb), the operator can assess whether the clubs shaft hangs to the left of plumb, to the right of plumb or perfectly vertical as illustrated in FIG. 6B. The operator can rotate the device within the shaft to change how the club hangs and thereby calibrate the device/golf club combination such that the selected viewing edge is perfectly parallel to the vertical plumb line 180 beyond (FIG. 6A). From any direction other than the selected and calibrated viewing direction, the club may hang well out of plumb. Once the device has been calibrated, it is then secured in the golf club shaft (as described above) to preserve the calibration. The calibrated device-club combination can then be used to assess the vertical plumb of any terrain (e.g. a golf course) by suspending the club from the balance points and comparing the selected viewing edge to the topography of the terrain. In so doing, a golfer can determine the direction to stroke a golf ball to ensure that the ball lands up in a desired location.

Figure 7A:
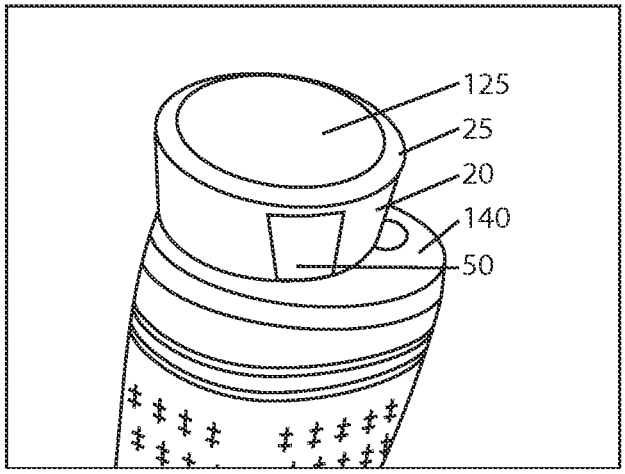
FIG. 7 shows an embodiment of the invention that includes a ball marker
Figure 7B:
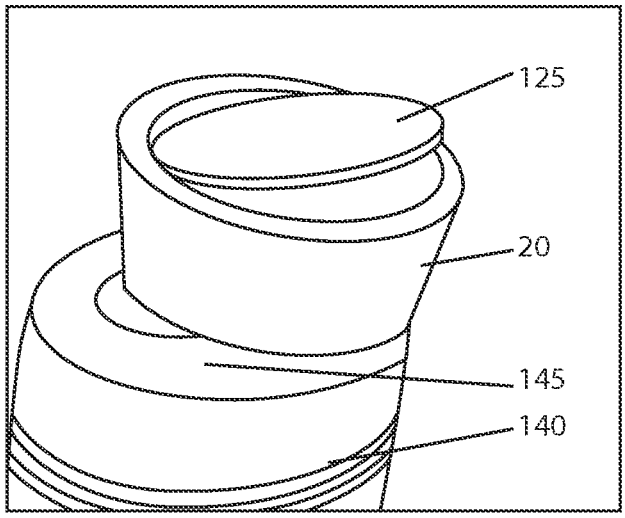
Figure 7C:
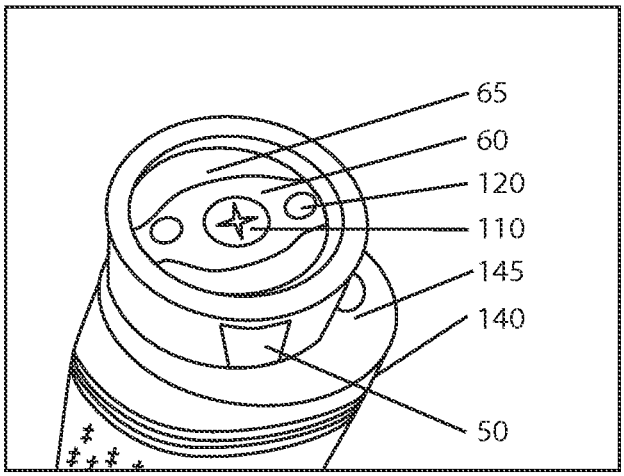

Various embodiments of the device can also include options and accessories. In one embodiment, the top of the device is adapted to accept a small, generally disc-shaped plastic or metal component that will typically fit flush with the surface of the top as illustrated in FIG. 7 A. The disc-shaped component acts as a cap for the device and can be removed for use as a ball marker 125. Such ball markers according to the invention can be any color and in certain aspects, can include lettering, designs, logos or other identifying markings. In certain embodiments, the ball marker snaps into a mated slot, depression or cavity in the top of the device. The slot can include a supporting ridge around all or part of the slot's circumference or perimeter, and may further include one or more supporting bridges 60. As shown in FIG. 7 B when the ball marker is supported by a bridge, it can be removed by pushing the ball marker in an area unsupported by the bridge 65. In other aspects, the device can be squeezed to eject the ball marker or the ball marker can be pried from the device. In certain embodiments, one or more magnets, such as rare earth magnets 120 (FIG. 7C), can be installed in the device to retain a metal ball marker. In other embodiments, the ball marker snaps into place in the device by close friction fit. The ball marker is used to stand in for a player's golf ball, e.g. when that ball might interfere with another player's game. The ball mark is used by placing it on the ground behind a golf ball. The ball can then be picked up at the player's discretion or as necessary. The ball can subsequently be replaced in front of the marker and the marker picked up and stored for future use in the top of the device.

Figure 8:
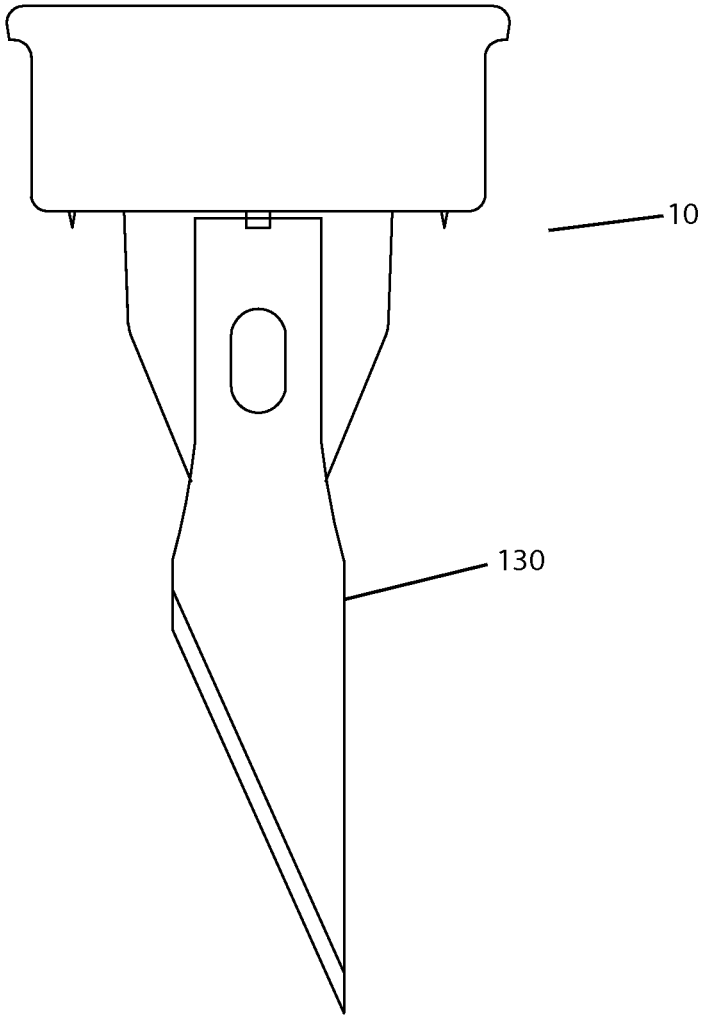
FIG. 8 shows an embodiment of the invention that includes a knife blade

In other embodiments, the device is adapted for storing a tool or accessory, and/or securing a tool for use. For example, a slot or other adaptation formed in the bottom of the device can be used to hold a knife blade 130 (e.g. a scalpel blade or X-acto knife blade) (FIG. 8). This allows the user to hold the device with the blade in it to cut a hole into the butt end 145 of the grip for insertion of the device. Once the hole is cut the blade is removed and discarded. Other tools needed for installing the device in the golf club shaft, such as screwdrivers, glue, tape or the like, can be stored and used in a similar fashion. When tightened, both the wedge and device engage the ends of the expanding tube. Ridges on the wedge and the device can be used to keep the wedge from spinning while tightening the screw. This allows the screw to pull the device firmly into the tube. The deeper the device engages the ends of the expansion tube (by tightening the screw), the larger the tube diameter grows.

Most standard golf clubs have an inner shaft diameter of about 0.485" to about 0.68" at the grip end 145. The device of the present invention can be made to fit any standard size golf club or can be adapted for larger or smaller non-standard sized golf or similar clubs.

The device and/or various parts thereof, can be made of any suitable material(s) known in the art including, but not limited to metal, metal alloys, plastic, wood and the like. In certain embodiments, the device is made from plastic, such as a PVC, polycarbonate, epoxy, polystyrene and/or other composites and resins well known in the art. Any plastic material can be used that has appropriate flow characteristics for the manufacturing process, and sufficient strength and toughness to withstand insertion, calibration and use as described herein. It will be apparent that certain parts or aspects of the invention require a more flexible material, such as expansion tube 90, while others a preferably rigid, such as spikes 40. The device can be manufactured by any suitable process, such as by molding, casting, carving, machining fabricating or combinations thereof. In one embodiment, the device is made by injection molding of plastic. In certain embodiments of the invention, the device is formed as a single piece of plastic or metal. In other embodiments, two or more pieces are manufactured and the parts assembled to form the device.

Although the foregoing invention has been described in some detail by way of illustration and example for purposes of clarity and understanding, it will be apparent to those of ordinary skill in the art in light of the teaching of this invention that certain changes and modifications may be made thereto without departing from the spirit or scope of the appended claims.

What is claimed is:

1. A device for reading the slope of a golf green comprising a) a generally conical body having a top, a bottom that is narrower than the top and at least one side, wherein the bottom has an outer diameter that is smaller than the inner diameter of the grip end of a generally hollow golf club shaft, and the top has an outer diameter that is larger than the inner diameter of the golf club shaft, such that at least the top of the device is retained outside the golf club shaft when the bottom is rotatably inserted into the grip end of the generally hollow golf club shaft;

b) a pair of positional balance markers disposed on opposite sides of a top portion of the body; and c) a means for securing the device in a fixed position in the golf club shaft comprising an expansion tube, a wedge, a bolt and nut, wherein the expansion tube is a generally cylindrical member adapted at one end for accepting the bottom of the device, and at the other end for accepting the top of the wedge, wherein the top of the wedge and the bottom of the device comprise male type fittings and the expansion tube comprises female fittings adapted to accept the male fittings, and wherein the expansion tube and wedge and are connected to the device with the bolt and nut.

2. A device for reading the slope of a golf green comprising a) a generally conical body having a top, a bottom that is narrower than the top and at least one side, wherein the bottom has an outer diameter that is smaller than the inner diameter of the grip end of a generally hollow golf club shaft, the top has an outer diameter that is larger than the inner diameter of the golf club shaft, and the at least one side is stepped to form an upper step portion adjacent to the top and a lower step portion adjacent to the bottom, wherein the lower step portion fits rotatably within the grip end of a generally hollow golf club shaft such that at least the top of the device is retained outside the golf club shaft;

b) a pair of positional balance markers disposed on opposite sides of a top portion of the body, wherein positional balance markers comprise raised protrusions disposed on opposite sides of the device that can be felt by the operator; and c) a means for securing the device in a fixed position in the golf club shaft comprising an expansion tube and a wedge, connected to the device with a bolt and a nut, wherein the expansion tube is a generally cylindrical member adapted at one end for accepting the bottom of the device, and at the other end for accepting the top of the wedge, wherein the top of the wedge and the bottom of the device comprise male type fittings and the expansion tube comprises female fittings adapted to accept the male fittings.

* * * * *